US006402624B1

(12) United States Patent
Larson et al.

(10) Patent No.: US 6,402,624 B1
(45) Date of Patent: Jun. 11, 2002

(54) AMUSEMENT RIDE WITHOUT HUBS AND SPOKES

(75) Inventors: Walter F. Larson; Jeffrey P. Novotny, both of Plainview, TX (US)

(73) Assignee: Versa Corporation, Plainview, TX (US)

( * ) Notice: Subject to any disclaimer, the term of this patent is extended or adjusted under 35 U.S.C. 154(b) by 0 days.

(21) Appl. No.: 09/439,772

(22) Filed: Nov. 15, 1999

Related U.S. Application Data

(60) Provisional application No. 60/108,984, filed on Nov. 18, 1998, now abandoned.

(51) Int. Cl.[7] ..... A63G 1/10
(52) U.S. Cl. ..... 472/44; 472/45; 104/63
(58) Field of Search ..... 472/44, 45, 39, 472/12, 7; 104/25, 89, 91, 63, 53

(56) References Cited

U.S. PATENT DOCUMENTS

| | | | | |
|---|---|---|---|---|
| 142,605 A | | 9/1873 | Yates | |
| 567,861 A | | 9/1896 | Mustain | |
| 728,246 A | | 5/1903 | Kremer | |
| 771,322 A | | 10/1904 | Pattee | |
| 803,465 A | | 10/1905 | Bernheisel | |
| 815,210 A | | 3/1906 | Pattee | |
| 815,211 A | | 3/1906 | Pattee et al. | |
| 887,082 A | | 5/1908 | Fraser | |
| 901,435 A | | 10/1908 | Fuller | |
| 944,407 A | | 12/1909 | Beebe | |
| 995,945 A | | 6/1911 | Berhold | |
| 1,557,942 A | | 10/1925 | Matthews | |
| 1,783,268 A | | 12/1930 | Traver | |
| 2,009,904 A | | 7/1935 | Purves | 180/21 |
| 2,046,678 A | | 7/1936 | Eyerly | 272/36 |
| 2,082,287 A | * | 6/1937 | Hermann | 472/44 |
| 2,135,230 A | | 11/1938 | Courtney | 104/76 |
| 2,158,073 A | | 5/1939 | Keith et al. | 272/36 |
| 2,384,237 A | | 9/1945 | Clark | 272/36 |
| 2,423,283 A | | 7/1947 | Austin | 272/36 |
| 2,498,450 A | | 2/1950 | Pewitt | 104/76 |
| 2,499,470 A | | 3/1950 | Duncan | 104/74 |
| 2,535,862 A | | 12/1950 | Pewitt | 272/36 |

(List continued on next page.)

FOREIGN PATENT DOCUMENTS

| | | |
|---|---|---|
| EP | 0 545 860 | 6/1993 |
| FR | 633775 | 2/1928 |
| GB | 21137 | 8/1912 |
| WO | WO 91/13662 | 9/1991 |
| WO | WO 93/24196 | 12/1993 |
| WO | WO 98 58718 | 12/1998 |

*Primary Examiner*—Kien T. Nguyen
(74) *Attorney, Agent, or Firm*—Thompson & Gustavson, L.L.P.

(57) ABSTRACT

An amusement ride (100) is disclosed which includes first and second vehicles (128, 130) which are supported in a cantilevered manner off cantilever beams (124, 126) from the stationary supporting track (102) to provide the occupants with the impression of being unsupported. The vehicles (128, 130) are floorless to enhance the effect for the passengers. A coaster style floorless amusement ride (150) is provided. A second embodiment of the amusement ride (200) has a floor style vehicle (202, 204). It can also be a coaster style amusement ride (220). A hubless and spokeless Ferris wheel (10) is also provided.

10 Claims, 7 Drawing Sheets

U.S. PATENT DOCUMENTS

| | | | | |
|---|---|---|---|---|
| 3,066,951 | A | 12/1962 | Gray | 280/206 |
| 3,299,565 | A | 1/1967 | Yarashes | 46/235 |
| 3,366,104 | A | 1/1968 | Totsuka | 40/18 |
| 3,507,222 | A | 4/1970 | Cirami | 104/53 |
| 3,536,324 | A | 10/1970 | Ahrens | 272/1 |
| 3,596,905 | A | 8/1971 | Brown | 272/29 |
| 3,610,160 | A | 10/1971 | Alimanestianu | 104/88 |
| 3,777,835 | A | 12/1973 | Bourne | 180/10 |
| 4,170,943 | A | 10/1979 | Achrekar | 104/56 |
| 4,221,170 | A | 9/1980 | Koudelka | 104/63 |
| 4,272,093 | A | 6/1981 | Filice et al. | 280/206 |
| 4,501,434 | A | 2/1985 | Dupuis | 280/206 |
| 4,545,574 | A | 10/1985 | Sassak | 272/6 |
| 4,988,089 | A | 1/1991 | Knijpstra | 272/29 |
| 5,021,901 | A | 6/1991 | Mondocea et al. | 360/92 |
| 5,060,932 | A | 10/1991 | Yanaguchi | 272/36 |
| 5,218,910 | A | 6/1993 | Mesmer et al. | 104/63 |
| 5,272,984 | A | 12/1993 | Bolliger et al. | 104/63 |
| 5,556,340 | A | 9/1996 | Bohn et al. | 472/59 |
| 5,660,076 | A | 8/1997 | Jonkka et al. | 74/399 |
| 5,759,107 | A | 6/1998 | Nagel | 472/47 |
| 5,791,254 | A | 8/1998 | Mares et al. | 104/53 |
| 6,098,549 | A | 8/2000 | Mares | 104/76 |

* cited by examiner

AMUSEMENT RIDE WITHOUT HUBS AND SPOKES

CROSS REFERENCE TO RELATED APPLICATIONS

This application claims priority to provisional application Serial No. 60/108,984 filed on Nov. 18, 1998 now abandoned.

TECHNICAL FIELD OF THE INVENTION

This invention relates to an amusement ride.

BACKGROUND OF THE INVENTION

Amusement rides provide entertainment for people around the world. People are always seeking new amusement and thrills, and there is a constant need to improve and design new amusement rides which will satisfy this need.

SUMMARY OF THE INVENTION

In accordance with one aspect of the present invention, an amusement ride is provided. The amusement ride includes a guide structure and a vehicle structure supporting at least the one person. A cantilever member having a first end and a second end is provided. The vehicle structure is mounted at the first end of the cantilever member. The second end of the cantilever member engages the guide structure for movement along the guide structure with the vehicle structure spaced from the guide structure by the cantilever member.

In accordance with another aspect of the present invention, the guide structure includes a plurality of guide rails extending along a predetermined direction, the cantilever member engaging the guide rails for movement along the rails in the predetermined direction. A second vehicle structure can be supported on a second cantilever member engaging the guide structure for movement along the guide structure on the side opposite of the original vehicle structure.

In accordance with another aspect of the present invention, the guide structure can be circular. An inertia ring is guided on said circular guide structure for rotation about a predetermined axis. The cantilever member is mounted for rotation with the inertia ring.

In accordance with another aspect of the present invention, an amusement ride is provided which does not require hubs and spokes. The amusement ride includes a track and an inertia ring. The inertia ring supports a number of cars. The inertia ring is caused to move in a circular direction, causing the cars to follow and provide a Ferris wheel type motion. Preferably, the cars are paired on either side of the inertia ring, allowing the cars to be supported externally of the track and provide a more thrilling ride.

BRIEF DESCRIPTION OF THE DRAWINGS

For a more complete understanding of the present invention and for further advantages thereof, reference is now made to the following detailed description, taken in conjunction with the accompanying drawings, in which.

DETAILED DESCRIPTION

With reference now to FIGS. 1–7, an amusement ride 100 will be described which forms a first embodiment of the present invention.

The amusement ride 100 is a floorless coaster which includes a stationary track 102 which is securely mounted by foundation 104 to the ground so that the stationary track is vertical, with its center axis of symmetry 106 extending horizontally. Alternatively, the track 102 could be mounted at any non-vertical angle, such as 45 degrees, or even mounted on foundation 104 for movement between two angles, for example, vertical to 45 degrees and back to vertical. As can best be seen in FIG. 2, the track 102 can be formed of a number of arcuate segments 102*a*, 102*b* and the like.

Figure 6:
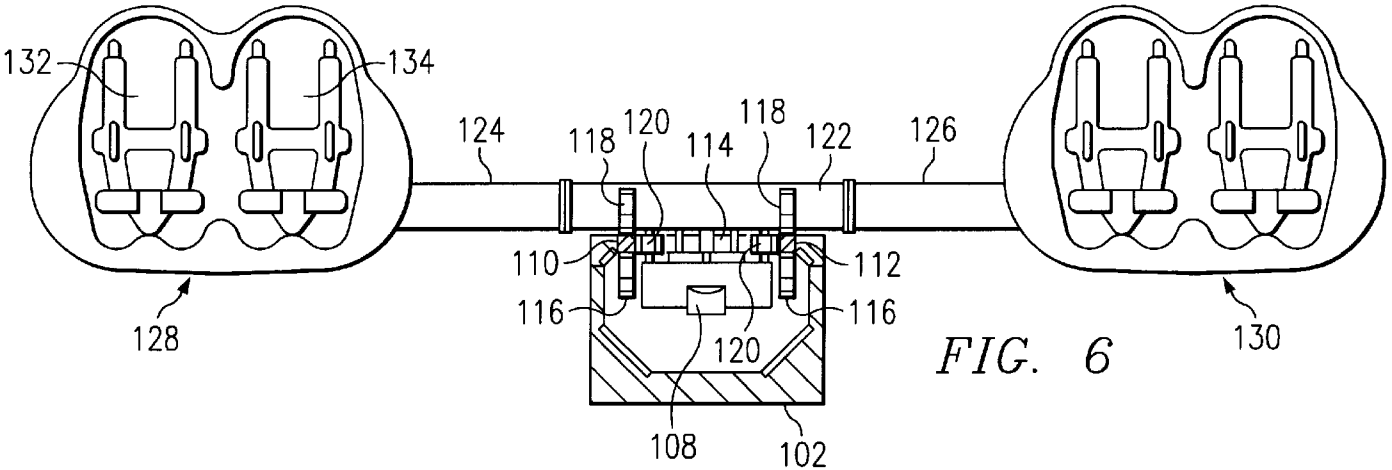
FIG. 6 is a detailed view of portions of the amusement ride.
Figure 7:
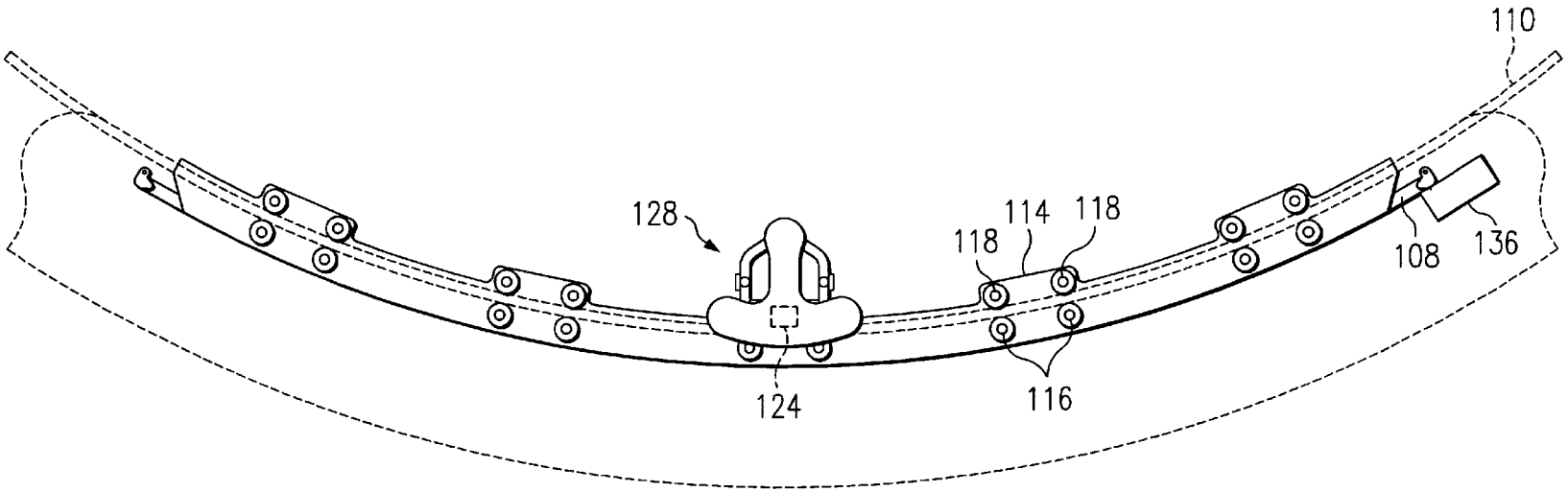
FIG. 7 is a partial side view of the amusement ride.
Figure 8:
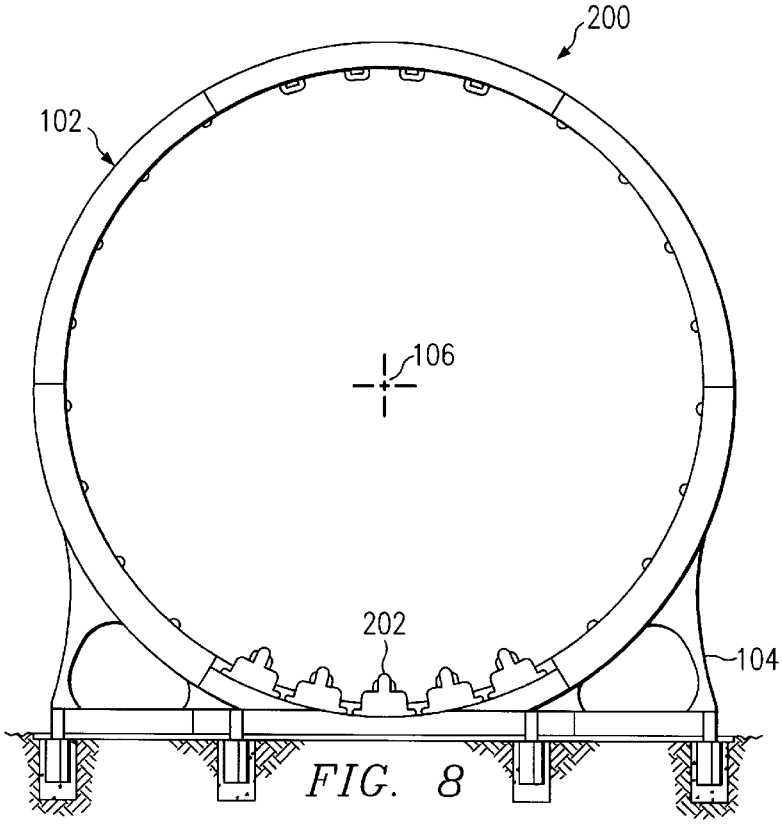
FIG. 8 is a side view of an amusement ride forming a second embodiment of the present invention which has a floor.

Within the track 102 is supported an inertia ring 108 which is capable of rotation about the axis of symmetry 106 while mounted on rails 110 and 112 mounted on stationary track 102, as best seen in FIG. 6. The inertia ring 108 is supported on the rails 110 and 112 by a series of undercarriages 114 which are distributed about the circumference of the inertia ring 108. As can be seen in FIGS. 6 and 7, each undercarriage has four pairs of wheel sets, with each set including an outer wheel 116 contacting the outer surface of a rail and an inner wheel 118 contacting the inner surface of a rail. In addition, a centering wheel 120 is preferably associated with each wheel set which centers the undercarriages 114 between the rails and prevents the undercarriages from being skewed relative thereto. Alternatively, two, three or more than four pairs of wheel sets can be used. Also, any other suitable mechanism can be used to support undercarriage 114 on rails 110 and 112 such as guides, etc.

Each undercarriage 114 mounts an attaching tube 122. The attaching tube 122 forms a first cantilever beam 124 on one side of the ring 102 and a second cantilever beam 126 on the other side of the ring 102. A first vehicle 128 is mounted at the end of the first cantilever beam 124 distant from the track 102 while a second vehicle 130 is mounted at the end of the second cantilever beam 126. Alternatively, an I-Beam, a rod, a square beam, a plate or any other suitable structure can be substituted for tube 122.

While the vehicles 128 and 130 can be of virtually any construction, they are illustrated to define a pair of seats 132 and 134 which are floorless, i.e. have no platform for resting the feet and are open, enhancing the thrill. Thus, seats 132 and 134 are similar, in this aspect of being floorless, to the common ski lift which has no structure for resting the feet.

Naturally, each of the seats 132 and 134 are provided with seat belts or other securing type structure to firmly secure a person within the seat, as is well understood in the technology.

A drive assembly 136 is used to induce rotation in the inertia ring 108, and therefore also in the undercarriages 114 and vehicles 128 and 130. The drive assembly 136 can be simply a rotating rubber tired wheel contacting the outside surface of the ring 108, thereby inducing rotation in the inertia ring 108.

Figure 1:
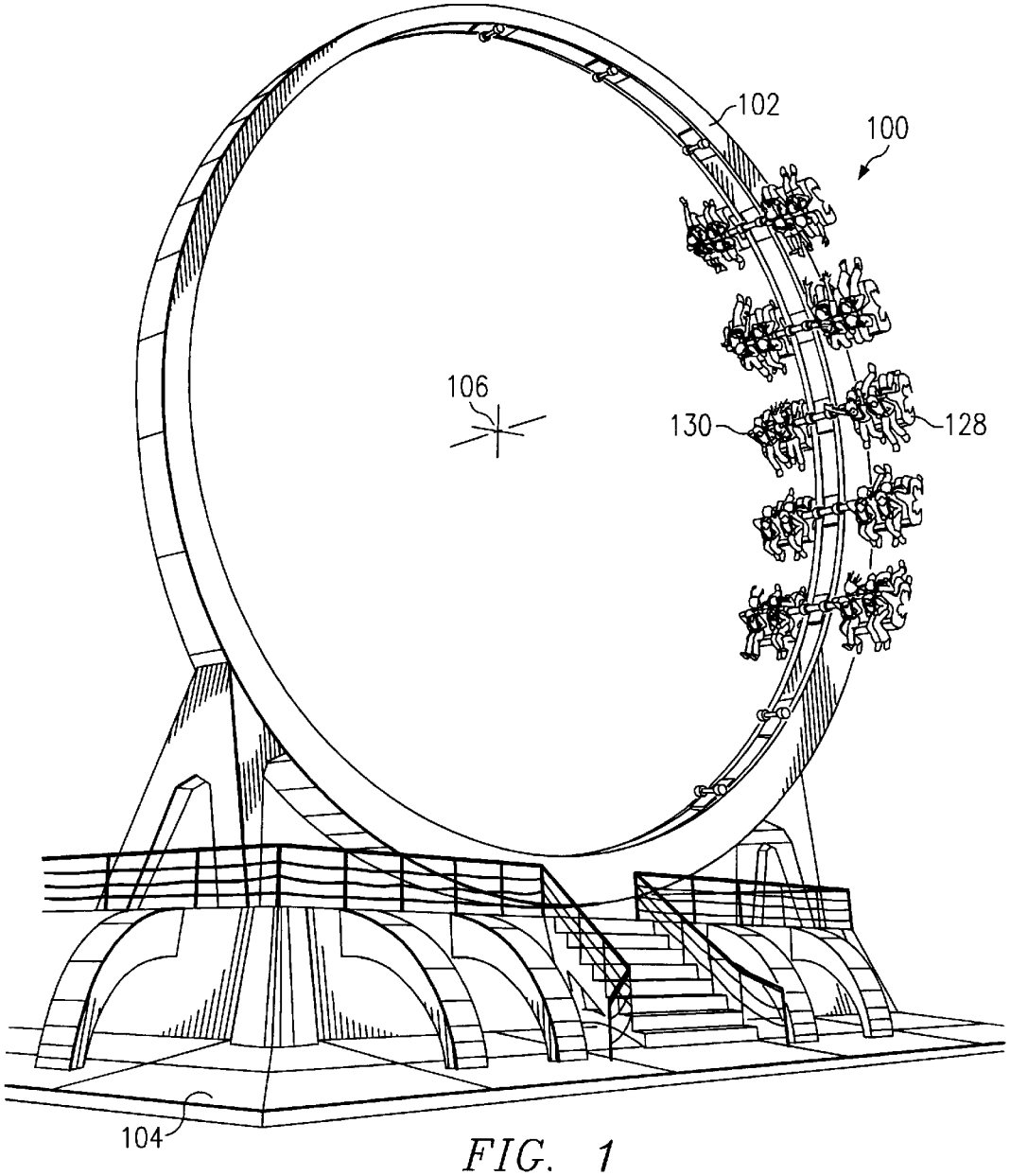
FIG. 1 is a perspective view of an amusement ride forming a first embodiment of the present invention.
Figure 11:
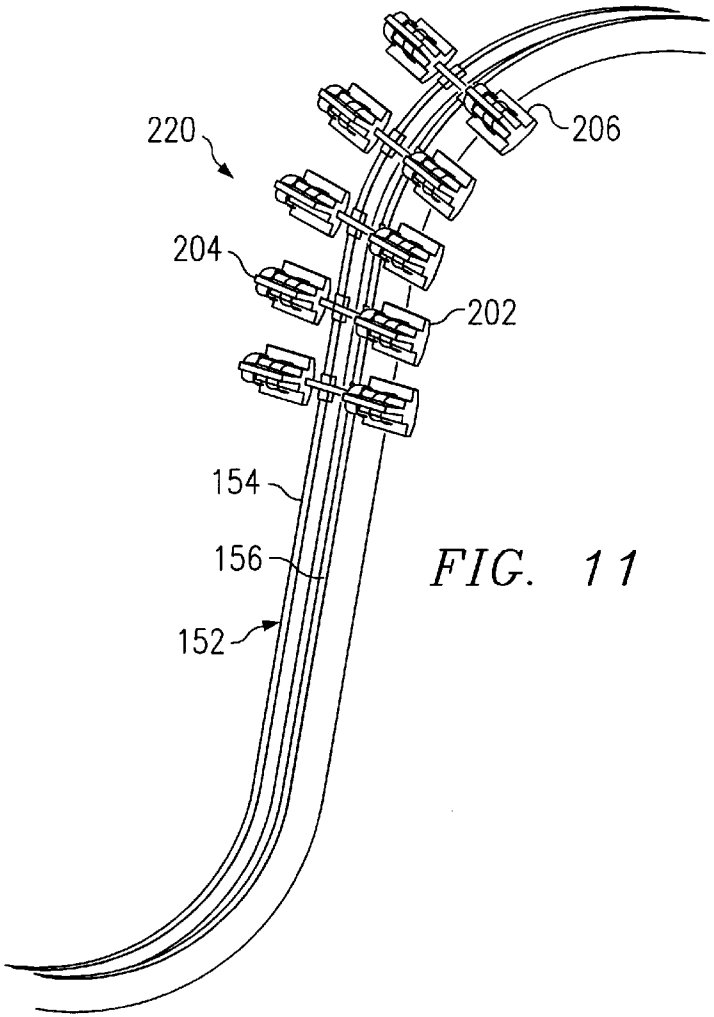
FIG. 11 is a perspective view of a portion of an amusement ride forming a first modification of the amusement ride of FIG. 8.
Figure 5:
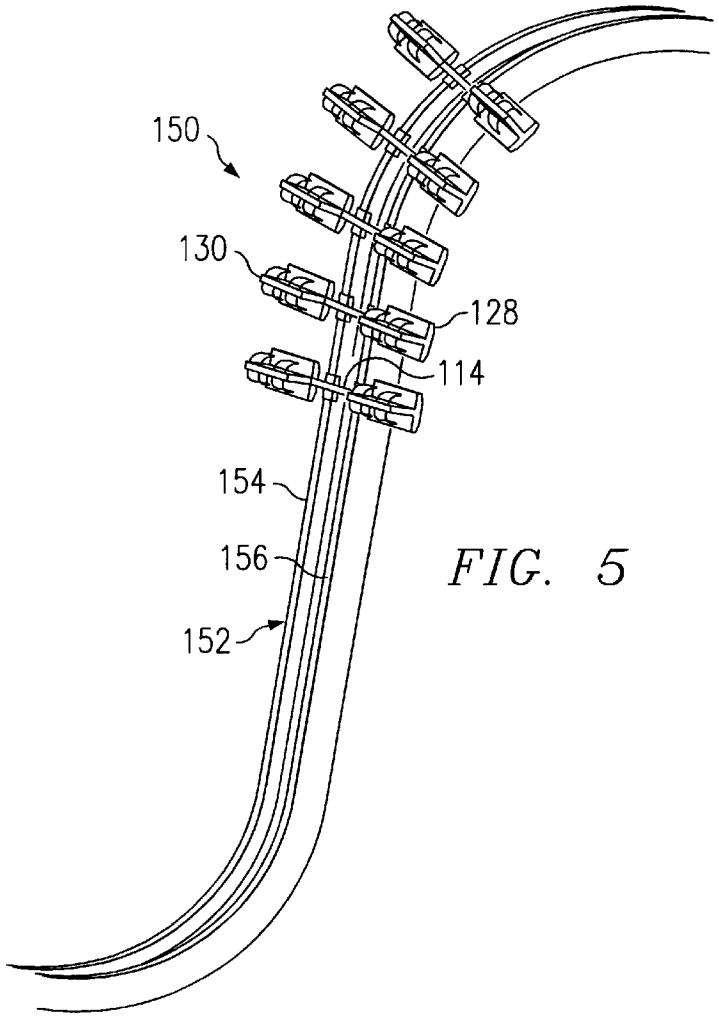
FIG. 5 is a perspective view of a portion of a modified amusement ride in a coaster style.

As can be appreciated, as the ring 108, carriages 114 and vehicles 128 and 130 are rotated about the axis of symmetry 106, the persons sitting in the vehicles 128 and 130 are provided with an exciting ride, which includes being upside down at the top of the track 102. Additionally, because the vehicles 128 and 130, riders therein, or both are cantilevered outward from the stationary track 102, the riders therein will have the impression of being suspended in space without support, enhancing the thrill of the ride. The vehicles 128 and 130 are in substantially the same plane as the track 102 as shown in FIGS. 1, 5, and 11. One definition of cantilevered outward from track 102 is to define a plane at the side of the track 102 closest to the rider or vehicle and have the rider or vehicle, or both, on the other side of the plane from the track. Another definition of cantilevered outward is to define a line which is the shortest distance between rails 110 and 112, i.e., a line perpendicular to the length of the rails, and then define a first plane perpendicular to the line and containing one rail and a second plane perpendicular to the line and containing the other rail. No part of either the rider or the vehicle, or both, lies between the first and second planes. That is, either the vehicle, or the rider, or both, is cantilevered outward from the plane containing the nearest rail.

As can be understood, the vehicles 128 and 130 can be of any configuration desired. Also, the amusement ride 100 can be made without second cantilever beam 126 and second vehicles 130, providing only first vehicles 128 cantilevered off of the first cantilever beams 124. While this would cause a force imbalance with the undercarriages 114 engaging the rails 110 and 112, this can be accommodated if desired.

As illustrated, five pairs of first and second vehicles 128 and 130 are used in the amusement ride 100. This provides the ability to load and unload all the occupants from the first and second vehicles 128 and 130 simultaneously when the inertia ring 108 is halted. However, it will be understood any number of first and second vehicles can be mounted on amusement ride 100.

Figure 2:
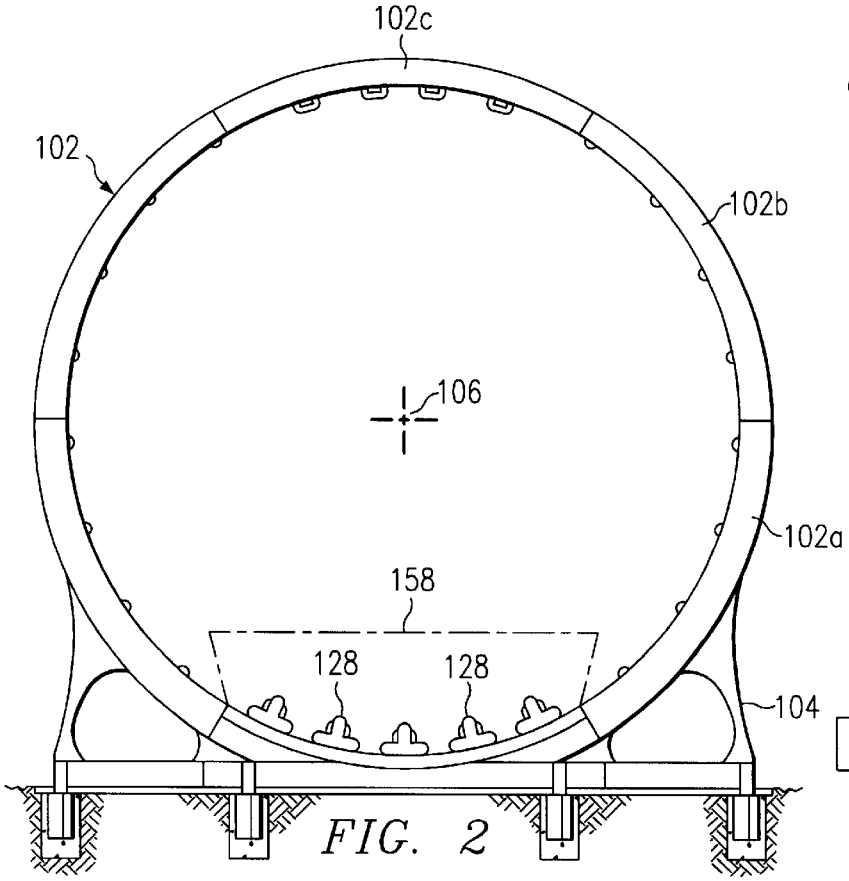
FIG. 2 is a side view of the amusement ride.
Figure 4:
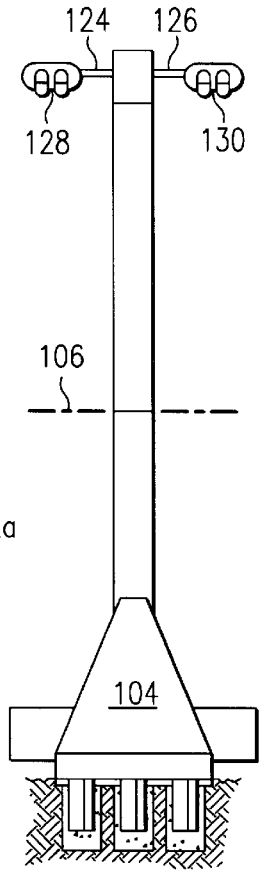
FIG. 4 is an end view of the amusement ride.
Figure 3:
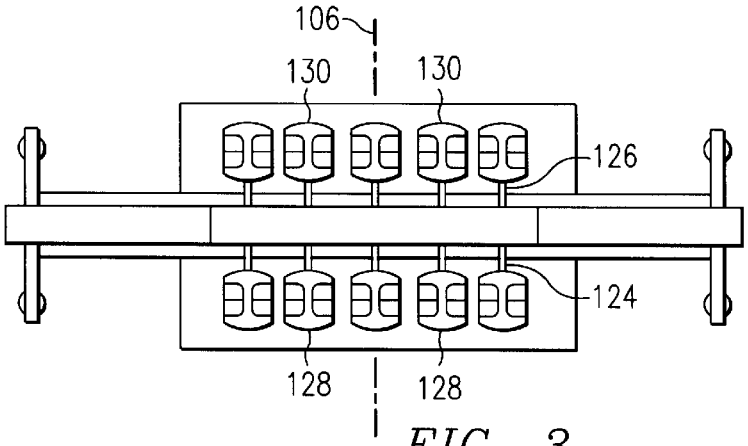
FIG. 3 is a plan view of the amusement ride.

If desired, the inertia ring 108 or undercarriages 114 opposite the vehicles 128 and 130 can have additional weight to compensate for the added weight of the vehicles 128, 130, beams 124 and 126 and the occupants thereof However, by maintaining some weight imbalance due to the beams 124 and 126, and vehicles 128 and 130, the amusement ride 100 will have a fail safe operation should the drive assembly 136 fail, causing the vehicles 128 and 130 to oscillate back and forth until they finally achieve a stationary position, such as seen in FIG. 2, allowing the passengers to be removed.

With reference to FIG. 5, a first modification of the present invention will be shown as amusement ride 150. Amusement ride 150 is, in contrast to the circular stationary track 102 of amusement ride 100, a coaster style amusement ride which extends in a serpentine manner or other configuration. While the coaster can form a closed loop, it need not do so. Amusement ride 150 is provided with a track 152 which defines the route of the coaster. The track 152, in turn, mounts rails 154 and 156 to support the undercarriages 114 in traveling the loop of the coaster. The vehicles 128 and 130, riders therein, or both are cantilevered outward from track 152. The planes defined above in amusement ride 100 would be defined in amusement ride 150 at the side of the track 152 or rails 154 and 156 proximate the position of the vehicles 128 and 130 at any given time.

As in a conventional coaster, a chain drive, linear induction motor or other mechanism can be utilized to raise the vehicles 128 and 130 and associated undercarriages 114 to the highest point on the coaster. Thereafter, gravity alone will cause the vehicles 128 and 130 and undercarriages 114 to move around the coaster.

Again, because of the cantilevered mounting of the vehicles 128 and 130 off of the beams 124 and 126, the occupants of the vehicles will have the impression that they are suspended without support in space, providing a thrilling ride.

In amusement ride 150, an inertia ring 108 is not utilized. However, structure should be provided between each of the undercarriages 114 and associated vehicles 128 and 130 to maintain proper spacing therebetween. Rigid beams can connect the undercarriages 114 if there is limited curvature in the rails 154 and 156 and sufficient play in the engagement between the wheels 116, 118 and 120 and the rails to prevent jamming of an undercarriage during the travel around the loop. Alternatively, hinge connections can be made between the undercarriages to accommodate some relative motion.

The present invention also provides the advantages of permitting an amusement ride 150 to be constructed using a conventional preexisting coaster. In such a construction, the conventional coaster track and rails will be used. The undercarriages 114 and vehicles 128 and 130 can then be mounted on the preexisting rails to complete the amusement ride 150. Undercarriages 114 can be redesigned as needed to mount on the preexisting rails. As can be appreciated, for an older, conventional coaster track which is still in satisfactory condition, this can provide a new life to the coaster track by presenting a new, thrilling ride in transforming the old coaster into an amusement ride 150. Alternatively, new rails 154 and 156 can be installed in the conventional coaster track if the preexisting rails are inadequate.

As seen in dotted line in FIG. 2, a design 158 can be mounted on the inertia ring 108 and/or the undercarriages 114 to provide an attraction to the occupants of the vehicle 128 and 130. For example, the design may be a viking ship, giving the occupants of the vehicles the feeling they are at the ends of oars extending from the sides of the viking ship. Design 158 can be a centipede, for example, giving the impression the occupants of the vehicles are at the end of a leg of the centipede. The use of a design 158 has the additional advantage of blocking the view of occupants in the first vehicles 128 from seeing the second vehicles 130, and vice versa, adding to the feeling of isolation of the occupants of the vehicles.

With reference now to FIGS. 8–11, an amusement ride 200 forming a second embodiment of the present invention will be described. Many of the structures in the amusement ride 200 are the same as used in the amusement ride 100 and are illustrated with the same reference numerals.

Figure 10:
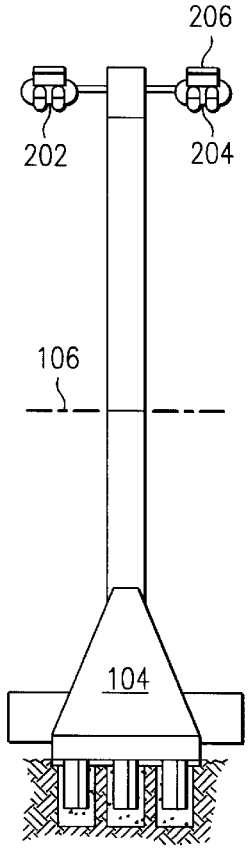
FIG. 10 is an end view of the amusement ride of FIG. 8.
Figure 9:
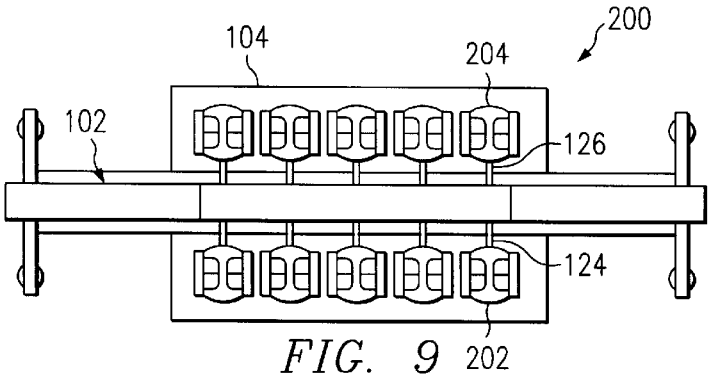
FIG. 9 is a plan view of the amusement ride of FIG. 8.

The amusement ride 200 has first vehicles 202 and second vehicles 204 which are more enclosed than the vehicles 128 and 130, and in fact, have floors 206 on which occupants can rest their feet and also to block the view of the occupants between their feet, providing less of a thrill than the amusement ride 100, but, to some occupants view, a more comfortable ride. As in amusement ride 100, the occupants of first and second vehicles 202 and 204 will be inverted at the top of the stationary track 102 during a portion of the ride, as seen in FIG. 10, in the version illustrated in FIGS. 8–10.

FIG. 11 illustrates an amusement ride 220 which is a first modification of amusement ride 200. Again, many structures therein are the same as found in amusement ride 150. However, first vehicle 202 and second vehicles 204 are more enclosed and are provided with floors 206. Amusement ride 220 is also a coaster style ride, just as amusement ride 150. Amusement ride 220 can use a preexisting conventional coaster track and rails, just as ride 150.

With reference to FIGS. 12–15, a Ferris wheel 10 forming a third embodiment of the present invention will be described. The Ferris wheel 10 differs from prior Ferris wheel designs in being a hubless and spokeless design. The Ferris wheel 10 includes a stationary track 12 which is securely supported on the ground through frame 14. An inertia ring 16 is supported within the track 12 for circular rotational motion about an axis 18 extending generally horizontally through the center line of the ring 16. The structure of the track 12 is designed so that the inertia ring 16 is generally not visible from exterior the Ferris wheel 10. A drive wheel assembly 20 is mounted within the stationary track 12 and has a pair of drive wheels 22 which rotate and induce circular motion in the inertia ring 16.

Figure 15:
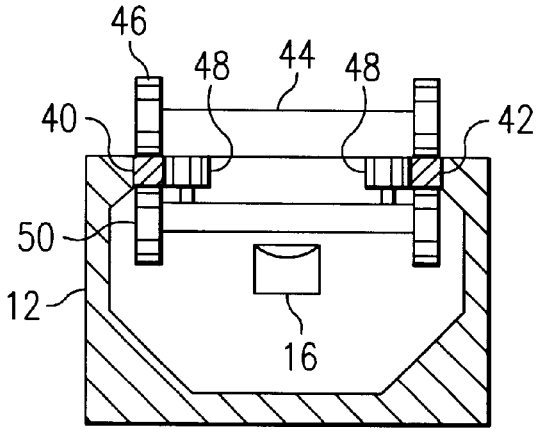
FIG. 15 is a partial cross sectional view of the ride along lines 4—4 in FIG. 12.

With reference to FIG. 15, the mounting of the inertia ring 16 to the track 12 will be further described. The stationary track 12 can be seen to have a generally u-shaped cross section that mounts guide rails 40 and 42 that face each other across the gap defined by the u-shape of the stationary track 12, the gap facing inward toward the axis 18. The guide rails 40 and 42 each form a continuous complete circle about the entire circumference of the stationary track 12. The inertia ring 16 mounts a series of carriage assemblies 44 at spaced intervals about its circumference which, in turn, mount a series of guide wheels 46, 48 and 50 which engage each of the rails 40 and 42 on three sides thereof As can clearly be understood, the guide wheels guide the inertia ring 16 for rotational motion relative track 12 about the axis 18 much in the same way as the inner race of a ball bearing. While the inertia ring 16 forms a complete circle, it can clearly be made up of arcuate sections of proper radius which are welded or otherwise secured together to form the complete circle.

Figure 13:
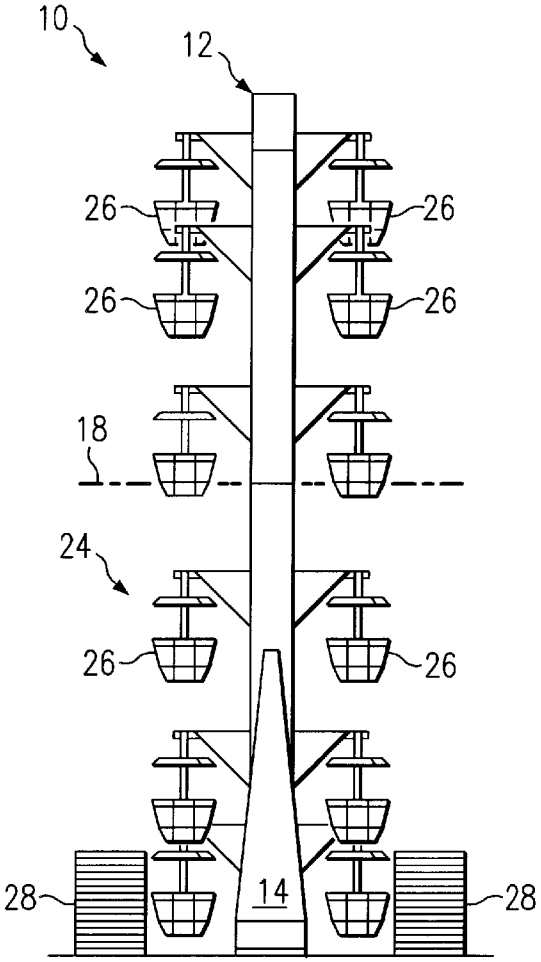
FIG. 13 is an end view of the amusement ride of FIG. 12.

Around the circumference of the inertia ring 16 are mounted a plurality of car assemblies 24. The car assemblies 24 can be mounted to the carriages 44, or directly to the inertia ring 16, or to a combination thereof Each assembly 24 consists of two cars 26 which are cantilevered horizontally in either direction from the inertia ring 16 so that the cars 26 are physically outside the confines of the stationary track 12, as illustrated in FIG. 13. This gives the opportunity to carry twice as many passengers in Ferris wheel 10 as compared to a conventional Ferris wheel design of similar diameter, as the conventional Ferris wheel can only mount one car at a time at a given location on the circumference of the Ferris wheel. When the inertia ring 16 is moved in a circular rotational motion about axis 18, the cars 26 will experience the same motion, creating a Ferris wheel type movement. However, the present device provides extra exciting features, one of which being that the cars are supported outside the track 12, providing the occupant with the feeling of being suspended in air with very little structure supporting them.

Figure 12:
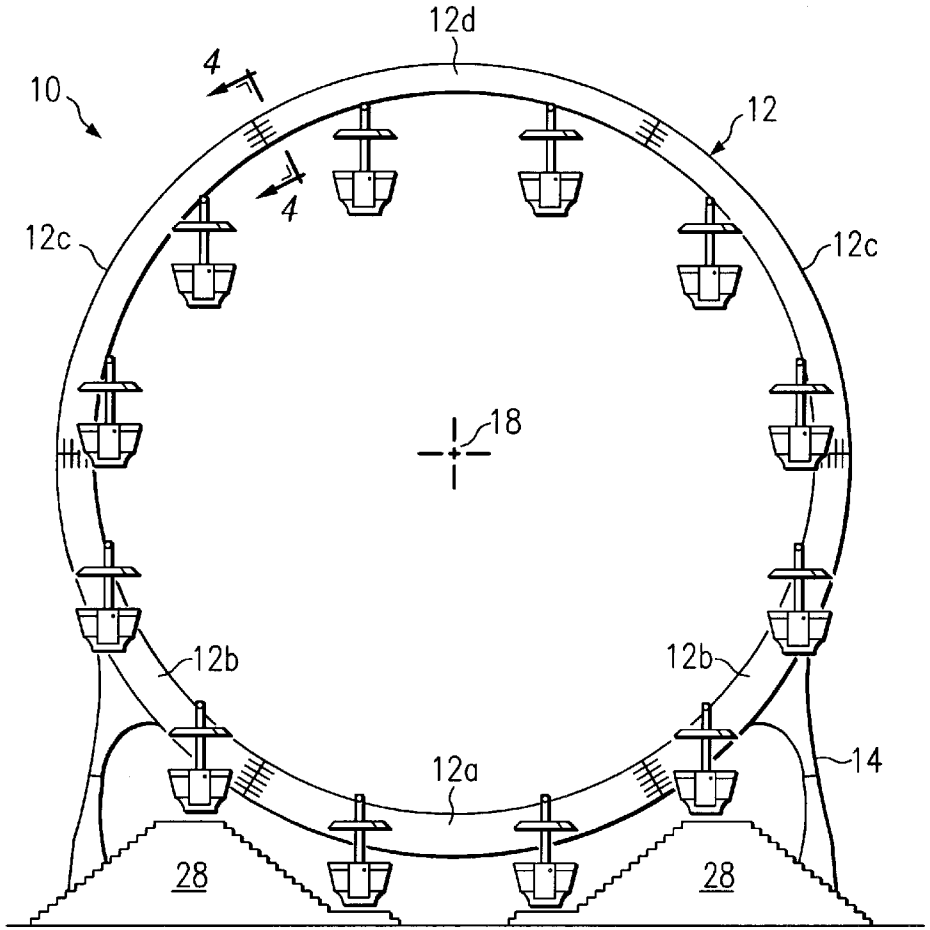
FIG. 12 is a side view of an amusement ride forming a third embodiment constructed in accordance with the teachings of the present invention.
Figure 14:
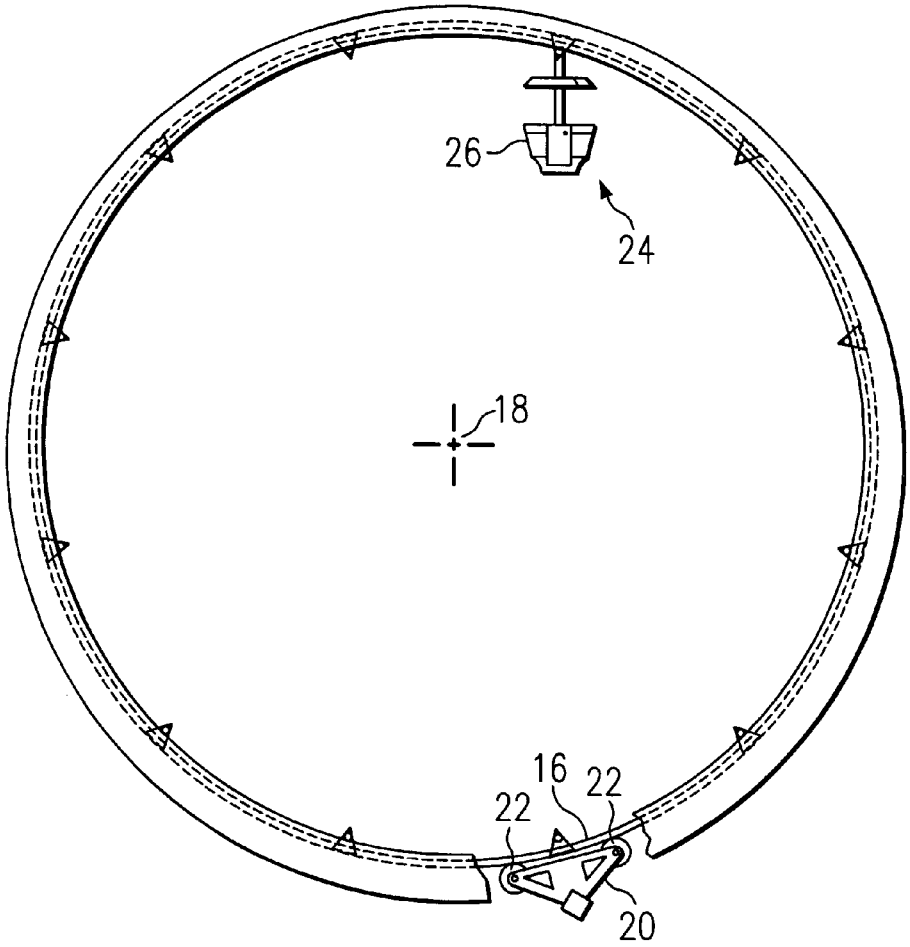
FIG. 14 is a partial side view of the amusement ride illustrating the operating mechanism.

Ramps 28 can be mounted adjacent the track 12 on the ground, as shown in FIG. 12, which allow four car assemblies 24 to be loaded and unloaded simultaneously as the inertia ring 16 is stopped. For a Ferris wheel 10 having twelve car assemblies 24 as shown, this means the entire Ferris wheel 10 can be loaded and unloaded with only three stops. Of course, any number of car assemblies, or other people carrying devices, can be mounted on ring 16, as desired.

As will be apparent from FIGS. 12 and 13, the stationary track 12 can be formed of a plurality of individual arcuate segments 12*a*, 12*b*, 12*c* and 12*d*, which are bolted, welded or otherwise secured together. The weight supported by the sections decreases from the sections near the ground to those at the upper end of the Ferris wheel 10, allowing section 12d to be less substantial than section 12*a*, for example, providing a pleasing tapering effect to the stationary track 12 clearly visible in FIG. 12.

In a variation, two inertia rings can be mounted side by side and supported for rotation about the axis 18 within the stationary track 12. Separate pairs of rails would typically be required, one pair to support each inertia ring, although a single, center rail could be designed to support part of each inertia ring without interference between the inertia rings, with single rails on either side of the center rail to support the other part of the inertia rings. The inertia rings can be rotated by separate drive wheel assemblies 20 so that each inertia ring rotates in an opposite rotational direction relative the other inertia ring. One inertia ring would support the cars 26 on one side of the stationary track 12, for example, the cars 26 on the left side of stationary track 12 shown in FIG. 13, while the other ring could support the cars 26 on the other side of the stationary track 12, such as the cars 26 on the right side of the stationary track 12 as seen in FIG. 13. This would provide an enhanced ride experience as the riders in one car 26 would have the impression that the cars on the other side of the stationary track 12 would be moving at twice the speed. A similar configuration can be used for amusement rides 100 and 200. The first vehicles 128 and 202 can be moving in one rotational direction while the second vehicles 130 and 204 are moving in the opposite direction. Similarly, with regard to the coaster style amusement rides 150 and 220, the first vehicles 128 and 202 can be separately mounted from the second vehicles 130 and 204. This would allow the vehicles to be staggered so that one vehicle proceeds the other, or, the vehicles can be started at the same time and can race each other to the end of the loop.

In one ride contemplated in accordance with the teachings of the present invention, 240 passengers could be accommodated on the ride at the same time.

Whereas the present invention has been described with respect to the specific embodiments illustrated, it will be understood that various changes and modifications will be suggested to one skilled in the art and it is intended to encompass such changes and modifications as fall within the scope of the invention.

What is claimed is:

1. An amusement ride, comprising:

a guide structure;

a vehicle structure supporting at least one person, said guide structure and said vehicle structure are in substantially the same plane; and a cantilever member having a first end and a second end, the vehicle structure mounted at the first end of the cantilever member, the second end of the cantilever member engaging the guide structure for movement along the guide structure, the vehicle structure spaced from the guide structure by the cantilever member, wherein the cantilever member is secured to an undercarriage, the undercarriage engaging the guide structure for movement along the guide structure.

2. The amusement ride of claim 1 wherein the guide structure includes at least one guide rail extending along a predetermined direction.

3. The amusement ride of claim 1 wherein the guide structure forms a circle.

4. The amusement ride of claim 1 wherein the guide structure forms a coaster.

5. The amusement ride of claim 1 wherein the vehicle structure is a floorless structure.

6. The amusement ride of claim 1 wherein the vehicle structure is a floored structure.

7. An amusement ride, comprising:

a guide structure;

a vehicle structure supporting at least one person, said guide structure and said vehicle structure are in substantially the same plane; and a cantilever member having a first end and a second end, the vehicle structure mounted at the first end of the cantilever member, the second end of the cantilever member engaging the guide structure for movement along the guide structure, the vehicle structure spaced from the guide structure by the cantilever member;

wherein the vehicle structure is a first vehicle structure, said cantilever member being a first cantilever member, said amusement ride further comprising a second vehicle structure supporting at least one person and a second cantilever member having a first end and a second end, the second vehicle structure being mounted at the first end of the second cantilever member, the second end of the second cantilever member engaging the guide structure for movement along the guide structure, the second vehicle structure being on a side of the guide structure opposite the first vehicle structure.

8. An amusement ride, comprising:

a guide structure;

a vehicle structure supporting at least one person;

a cantilever member having a first end and a second end, the vehicle structure mounted at the first end of the cantilever member, the second end of the cantilever member engaging the guide structure for movement along the guide structure, the vehicle structure spaced from the guide structure by the cantilever member; and an inertia ring mounted for rotation on said guide structure, said cantilever member engaged to said inertia ring.

9. A Ferris wheel, comprising:

a circular guide structure;

an inertia ring mounted on the guide structure for rotation about a rotational axis; and at least one gondola supported on said inertia ring for rotational motion with the inertia ring.

10. The Ferris wheel of claim 9 wherein the gondola is on a first side of the guide ring, a second gondola being supported on the inertia ring on a second side of the guide ring.

* * * * *